United States Patent [19]

Gordin

[11] Patent Number: 4,725,934

[45] Date of Patent: Feb. 16, 1988

[54] GLARE CONTROL LAMP AND REFLECTOR ASSEMBLY AND METHOD FOR GLARE CONTROL

[75] Inventor: Myron K. Gordin, Oskaloosa, Iowa

[73] Assignee: Mycro-Group Company, Oskaloosa, Iowa

[21] Appl. No.: 91,364

[22] Filed: Aug. 28, 1987

Related U.S. Application Data

[63] Continuation of Ser. No. 865,086, May 19, 1986, abandoned, which is a continuation of Ser. No. 687,864, Dec. 31, 1984, abandoned.

[51] Int. Cl.[4] ..... F21V 7/00

[52] U.S. Cl. ..... 362/298; 362/256; 362/346; 362/277

[58] Field of Search ..... 362/297, 298, 301, 302, 362/303, 304, 346, 347, 255, 256, 431, 319, 277, 282, 343, 247, 248; 313/114, 117

[56] References Cited

U.S. PATENT DOCUMENTS

| | | | |
|---|---|---|---|
| 1,166,244 | 12/1915 | Norton | 362/347 |
| 1,249,133 | 12/1917 | Lebby | 362/303 |
| 1,397,803 | 11/1921 | Ensor et al. | 362/305 |
| 1,466,354 | 8/1923 | Drury | 362/298 |
| 1,610,105 | 12/1926 | Moise | 362/298 |
| 1,660,067 | 2/1928 | Burtis | 362/298 |
| 1,691,209 | 11/1928 | Raynolds et al. | 362/255 |
| 1,751,111 | 3/1930 | Steele et al. . | |
| 1,876,138 | 7/1932 | Christmas | 362/298 |
| 1,998,967 | 4/1935 | Raynolds | 362/298 |
| 2,277,563 | 3/1942 | Scott et al. | 362/298 |
| 2,826,710 | 3/1958 | Lipscomb | 313/117 |
| 4,261,029 | 4/1981 | Mousset | 362/297 |
| 4,338,655 | 7/1982 | Gulliksen | 362/297 |
| 4,351,018 | 9/1982 | Fratty | 362/297 |
| 4,423,471 | 12/1983 | Gordin et al. | 362/431 |

FOREIGN PATENT DOCUMENTS

| | | | |
|---|---|---|---|
| 210185 | 1/1956 | Australia | 362/297 |

*Primary Examiner*—William A. Cuchlinski, Jr.
*Assistant Examiner*—D. M. Cox
*Attorney, Agent, or Firm*—Zarley McKee, Thomte, Voorhees & Sease

[57] ABSTRACT

A glare control lamp and reflector assembly and method for glare control which includes a conventional lamp and symmetrical reflector for providing a controlled light beam to a target area. A reflector shield can be positioned on the reflector below the lamp and has the properties of diverging incident light downwardly towards the target area and thus controls reflection upwardly which would produce glare. A glare shield can be positioned on the top of the reflector and extends outwardly from the outer edge of the reflector to block both direct light and reflected light from traveling upwardly and outwardly which would produce glare. In a further combination, a lamp shield can be positioned over a portion of the outermost extending end of the lamp to prevent unreflected light from directly causing glare. The method for controlling glare includes the steps of providing a conventioal lamp and reflector assembly, positioning a reflector shield in the bottom of the reflector beneath the bulb to diverge instant light downwardly to the target area, and providing a glare shield extending around and outwardly from the top of the reflector to block and divert incident light downwardly towards the target area. An additional step would be to provide a lamp shield over the outwardmost end of the lamp to block directly emanating light from causing glare.

27 Claims, 8 Drawing Figures

GLARE CONTROL LAMP AND REFLECTOR ASSEMBLY AND METHOD FOR GLARE CONTROL

This is a continuation of Ser. No. 865,086, filed May 19, 1986, now abandoned, which is a continuation application of Ser. No. 687,864, filed on Dec. 31, 1984, now abandoned.

BACKGROUND TO THE INVENTION

1. Field of Invention

This invention relates to glare control for lighting fixtures, more particularly to a means and method for controlling glare in conventional lamp and symmetrical reflector lighting units.

2. Description of Problems in the Art

In many lighting applications, there is a need for the combination of a controlled beam, with a significant amount of intensity, provided as efficiently as possible. In such applications, the conventional lamp and symmetrical reflector light fixture is the usual selection for equipment.

There are many different types of lamps and symmetrical reflectors which can be used for these applications, but a typical and detrimental problem with such lights is the glare that they produce. The higher in intensity or the more powerful the light, the higher the potential for glare.

The magnitude of the glare problem can be illustrated by specific examples. In outdoor sports lighting, the combination of the high intensity needed and the height of the suspension of the light fixtures creates glare problems not only for nearby houses and businesses, but also for persons substantial distances away. Although the level of light received at those locations is nominal, the perceived intensity caused by glare creates a bothersome nuisance to those affected. Its seriousness can include creating momentary blindness if directly looked at, which can cause serious problems with automobile traffic which may be affected by the glare.

Another example involves use of lighting on television or movie sets or the like, wherein the glare is detrimental at various camera angles for recording a scene on film.

Glare can be a problem even with the direct participants and spectators themselves, including both outdoor and indoor sports lighting, if the participant or spectator is positioned at a place which the glare directly affects, thereby affecting sight and visibility.

Thus, there is a real need in the art for means or methods of controlling glare. There are presently some attempts to provide glare control for general lighting fixtures, but no successful method is known for high intensity, controlled beam, wide area lighting utilizing symmetrical reflectors.

It is therefore an object of this invention to provide a means and method for glare control for conventional lamp and symmetrical reflector assembly lighting units which improves upon the deficiencies or solves the problems in the art.

It is a further object of this invention to provide a means and method for glare control for conventional lamp and symmetrical reflector assembly lighting units which controls glare generated by the lamp and reflector of a conventional lamp and symmetrical reflector assembly lighting unit.

A further object of this invention is to provide a reflector assembly which controls glare from a conventional lamp and symmetrical reflector lighting unit.

Another object of this invention is to provide a lamp shield which controls glare directly from the lamp of a conventional lamp and reflector lighting unit.

A further object of this invention is to provide a means and method for controlling glare of a conventional lamp and symmetrical reflector lighting unit which is adjustable for each glare problem.

Another object of this invention is to provide a means and method for controlling glare of a conventional lamp and symmetrical reflector lighting unit which achieves glare control with a minimum reduction in the amount of light intensity reaching the target area.

Another object of the invention is to provide a means and method for controlling glare of a conventional lamp and symmetrical reflector lighting unit which utilizes maximum gathered and reflected light to present to the target area.

A further object of this invention is to provide a means and method for controlling glare of a conventional lamp and symmetrical reflector lighting unit which is adjustable in design, economical, and durable.

Another object of this invention is to provide a means and method for controlling glare of a conventional lamp and symmetrical reflector lighting unit which can be retrofitted to existing conventional lamp and reflector lighting units.

These and other features, objects, and advantages of the invention will become apparent to those skilled in the art with reference to the accompanying specification.

SUMMARY OF THE INVENTION

This invention utilizes a specialized reflector assembly in a conventional lamp and symmetrical reflector lighting unit to control glare from the lighting unit. A conventional lighting unit generally consists of a lamp socket, a lamp operatively mounted therein, and a symmetrical reflector in association with the lamp to provide a controlled light beam from the light of the lamp to a target area.

One means and method for controlling glare according to the invention consists of a reflector assembly comprised of the conventional symmetrical reflector, a reflector shield and a glare shield.

The reflector shield comprises a piece of reflective material which is mounted or positioned beneath the lamp on the bottom half of the interior surface of the conventional converging symmetrical reflector. The reflector shield is in effect a diverging reflector in that it diverts all incident light upon it downwardly towards the target area and thereby prevents incident light, whether direct or reflected, from projecting upwardly and outwardly and therefore producing glare.

The reflector shield can cover up to approximately the entire bottom half of the interior of the reflector, or can cover an angular section thereof depending on requirements.

A glare shield is mounted or positioned around the peripheral edge of the reflector, usually the upper one-half or more of the reflector. The glare shield extends outwardly from the peripheral edge of the reflector and serves to block light, whether direct or reflected from the lamp, from traveling upwardly and outwardly and causing glare. Additionally, the glare shield diverts substantial incident light downwardly towards the target area.

An additional embodiment of the invention involves utilization of a lamp shield to further reduce and control glare. The lamp shield is mounted or positioned over the upper part of the outwardmost end of the lamp to prevent and block directly emanating light, which can cause glare. The major purpose of the lamp shield is to force as much as possible, the light emanating from the lamp to be reflected from either the reflector or the reflector shield. The lower part of the end of the lamp is left uncovered because the directly emanating light would mostly be directed to the target area.

The method of controlling glare includes the steps of providing the conventional lamp and reflector lighting unit with a glare shield, reflector shield or lamp shield, or any combination thereof, depending upon the nature of the glare which is required to be controlled. This includes retrofitting existing lighting units to control glare.

DETAILED DESCRIPTION OF THE PREFERRED EMBODIMENT

Figure 1:
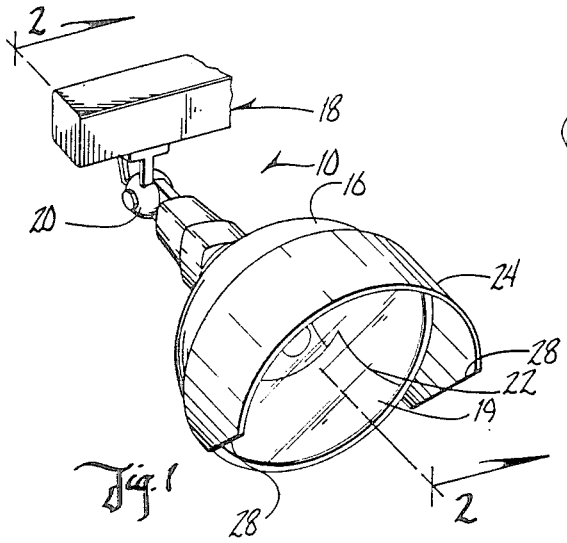
FIG. 1 is a perspective view of one embodiment of the glare control assembly.

In reference to the drawings, and in particular FIG. 1, there is shown a glare control lamp and a reflector assembly 10 in accordance with the invention. The assembly 10 consists first of a lamp 12 operatively connected and secured to a lamp socket 14. A conventional symmetrical reflector 16 surrounds lamp 12 to provide a controlled beam of light. Symmetrical reflector 16 is a converging reflector in both its upper and lower hemispheres, meaning that reflector 16 causes the light reflected from it to emanate in a converging manner.

As is conventional, lamp socket 14 is adjustably mounted to a support 18 by a vertically and horizontally adjustable connecting elbow 20. Likewise, conventionally, a transparent cover 19 is placed over lamp 12 and reflector 16.

A reflector shield 22 is mounted on the lower surface of reflector 16, beneath lamp 12. Reflector shield 22 is of such configuration that it forms a diverging reflecting surface thus transmitting incident light divergingly downward.

A glare shield 24 is mounted perimetrically around the circumferal perimeter of the upper portion of reflector 16 and extends outwardly therefrom. Glare shield 24 blocks light eminating directly out of lamp 12 and reflecting off of reflector 16 from traveling upwardly and outwardly and thus reduces glare. Glare shield 24 also prevents waste of dissipated upward light and concentrates the light where it is needed, on the target area.

The combination of reflector shield 22 and glare shield 24 serves to control direct and reflected light from lamp 12 and reflector 16 to minimize light being directed away from the target area, and more particularly, to prevent light from traveling upwardly and outwardly, which produces the most glare.

Figure 2:
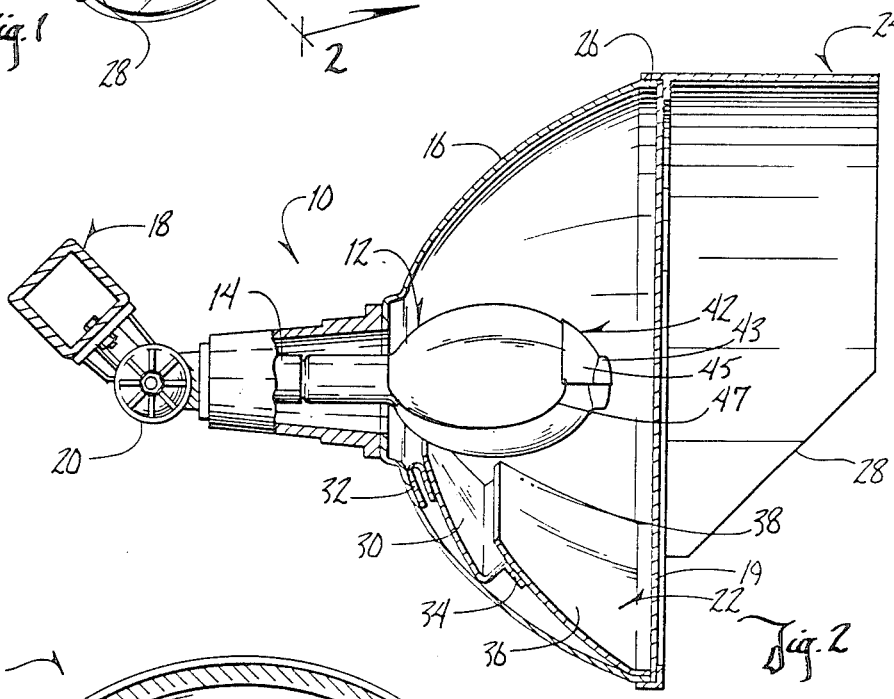
FIG. 2 is a sectional view taken along line 2—2 of FIG. 1.

By referring to FIG. 2, the exact structure of this embodiment of invention 10 can be more clearly seen. Glare shield 24 can extend around the upper hemisphere of reflector 16. Exactly how far glare shield 24 extends depends on the glare control needed, therefore, it can extend less than or greater than 180° of its circumference according to choice and needs. Lip 26 is mateable around the exterior of reflector 16 allowing secure mounting of glare shield 24 with no gaps. Bevelled edges 28 of glare shield 24 further prevent glare from the sides of invention 10, and yet allows maximum light to reach the target area.

FIG. 2 shows a first embodiment of reflector shield 22. Because of the close distance between reflector shield 22 and lamp 12, a very shallow reflection angle is formed between the two, especially at the end of reflector shield 22 nearest lamp 12. Therefore, it has been found that a two-part stepped reflector shield 22 can be effectively used. An inner section 30 is mounted by U-shaped bracket 32 to the interior of reflector 16 at the required reflection orientation to lamp 12. Inner section 30 has an inverted L-shaped outer edge 34, which in turn supports outer section 36 of reflector shield 22. The size of L-shaped outer edge 34 is such that it holds outer section 36, which is attached at its outer edge to the interior outer edge of reflector 16, at such an orientation as to achieve the proper reflection angle with respect to lamp 12.

Figure 3:
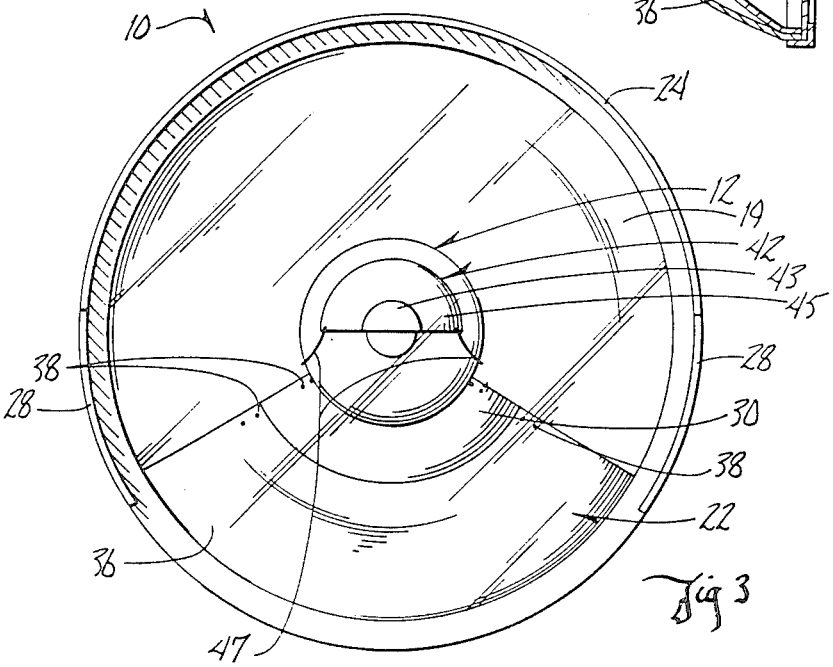
FIG. 3 is a front elevational view of the embodiment of FIG. 2.

The function of reflection shield 22 is to control glare by diverging incident light downwardly towards the target area, instead of allowing reflected light from the bottom of the symmetrical converging reflector to be directed upwardly and outwardly, a prime cause of glare. FIG. 3 shows a front elevational view of the two section reflection shield 22 of FIG. 2. By nature of the size, configuration, and glare controlling properties of glare shield 24, it is preferred that reflector shield 22 occupy an angular section of 180° or less of the interior of reflector 16. In the embodiments shown in the drawings, the angular section is approximately 120°. Angular sections of less than 180° are desired to maximize the amount of gathered and reflected light from lamp 12. Inner and outer sections 30 and 36 of reflector shield 22 can be attached to one another and to reflector 16 by means of rivets 38 or can be otherwise attached or spun into one continuous shape.

It is to be noted that reflector shield 22 can be made of any material which has good reflective qualities and which can withstand the heat produced by high intensity lamps. Aluminum is a preferred material.

Figure 6:
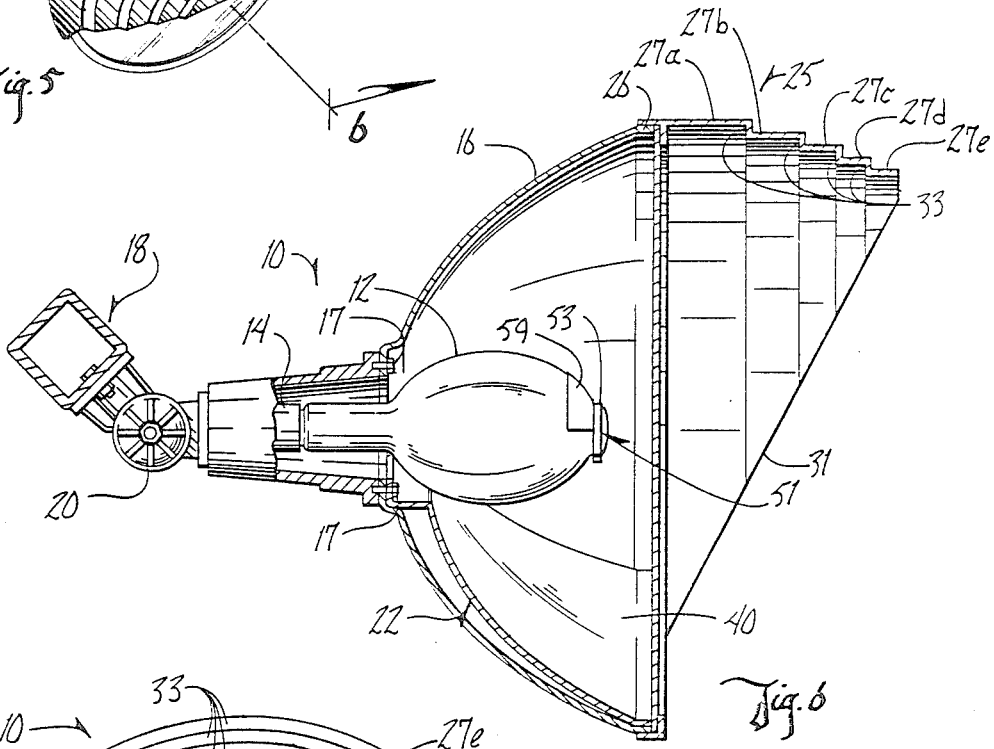
FIG. 6 is a sectional view taken along lines 6—6 of FIG. 5 showing alternative embodiments of the glare shield, reflector shield, and lamp shield.
Figure 7:
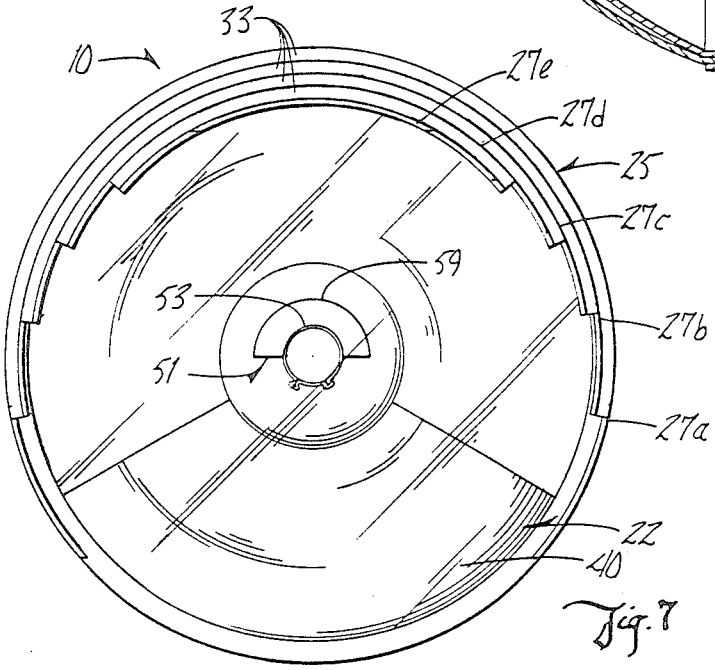
FIG. 7 is a front elevational view of the assembly of FIG. 6.

A second embodiment of reflector shield 22 is depicted in FIGS. 6 and 7. Instead of a two-piece configuration, reflector shield 22 could be constructed from a one-piece member 40, which is mounted to, and held in the correct reflective orientation with respect to lamp 12 by U-shaped bracket 32 and any mounting means known in the art. Alternatively, it could be attached to the base of reflector 16 by the very bolts or screws 17 used to attach reflector 16 to lamp socket 14, as seen in FIG. 3.

Figure 5:
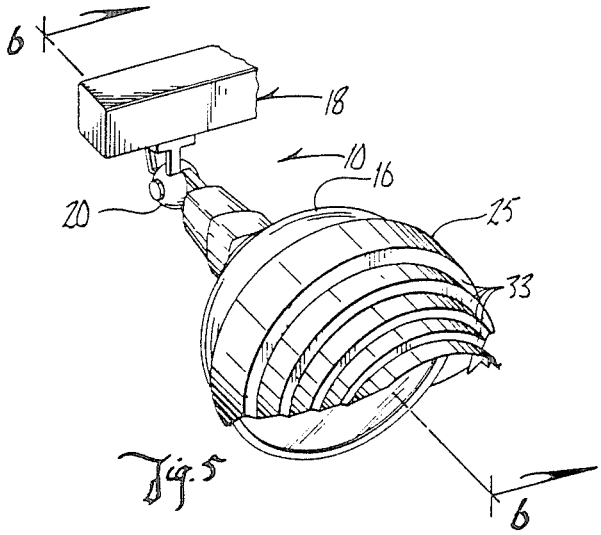
FIG. 5 is a perspective view of another embodiment of the glare control assembly.

FIGS. 5, 6 and 7 also show an alternative embodiment of the glare shield, here referred to as stepped glare shield 25. Stepped glare shield 25 is the preferred embodiment because it causes more light to be redirected to the target area and allows the lamp shield to be smaller, as is discussed below, thus further allowing more light to reach the target area. By referring to FIGS. 5 and 7, it can be seen that stepped glare shield 25 has an angled edge 31 along its side which determines the glare cut-off point. Each step in the glare shield referenced by numerals 27*a–e* has a decreasing diameter and is attached to the preceeding step by brackets 29. Each step 27*a–e* is a flat curved piece and can be of varying widths. A corresponding curved vertical piece 33 is secured between adjacent steps 27*a–e*. Alternatively, stepped glare shield could be manufactured as one piece.

Figure 4:
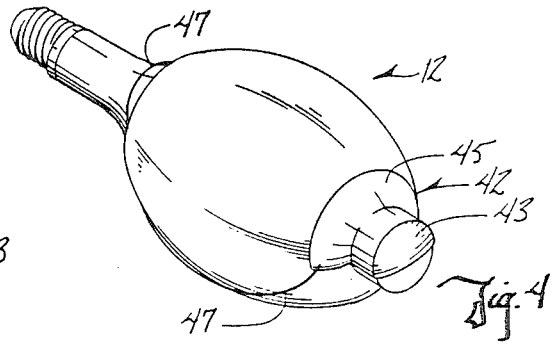
FIG. 4 is a perspective view of a lamp with one embodiment of a lamp shield mounted thereon.

The drawings also depict embodiments of an additional feature of the invention which can be employed to further control glare. A first embodiment of a lamp shield is shown in FIGS. 2, 3 and 4 by reference numeral 42. A second embodiment is referred to by numeral 51 in FIGS. 6, 7 and 8.

A lamp shield can be placed either directly upon or in association with the outer end of lamp 12. By covering the upper part of the outer end of lamp 12, as shown, directly emanating light from that part of lamp 12 is blocked and reflected, forcing the light to be directed to the reflecting surfaces of the assembly 10. This blockage of directly emanating light from the end of lamp 12 further enhances glare control.

Lamp shield 42 is shown on lamp 12 in FIG. 4 and in operation in FIGS. 2 and 3. A nose piece 43 covers and encloses the upper part of the nose end of lamp 12. A fan shaped, curved portion 45 extends rearwardly of nose piece 43 and covers an angular section of the front top of lamp 12. A wire 47 is attached at opposite lateral sides of portion 45 and extends around the back of the upper side of lamp 12 to support and keep lamp shield 42 in place.

Figure 8:
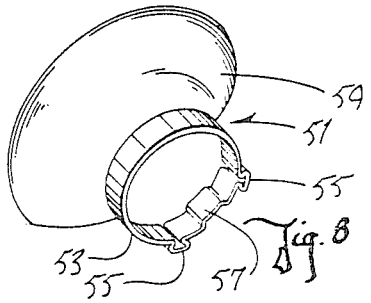
FIG. 8 is a perspective view of an alternative embodiment of the lamp shield.

Lamp shield 51 of FIGS. 7 and 8 utilizes a full band 53 to secure it to lamp 12. Bent portions 55 and 57 provide retentive spring action to band 53. Portion 59 is similar to portion 45 of lamp shield 42. Other methods for retaining the lamp shield to lamp 12, such as are known in the art, could also be used.

It is to be understood that lamp shield 42 or 51 covers an angular section of the outer end of lamp 12, generally between 120° and 180° of the upper part of the upper end of lamp 12. The lamp shields 42 and 51 shown in the drawings cover approximately 180° of the end of lamp 12. The exact angular section covered by the lamp shield is determined by the amount and kind of glare control needed and is coordinated with the size and coverage of the glare shield. It is generally between 180° and 120° but could be an even smaller angular section, depending on the glare shield used. The lamp shield is made of a material that is reflective, and which can withstand high temperature, such as aluminum. The major purpose of lamp shields 42 and 51 is to block and redirect light emanating directly from the end of lamp 12 which would project upwardly and outwardly from invention 10 without being reflected by glare shield 24, and at the same time to prevent direct line-of-sight glare. Therefore, depending upon the nature of the glare problem, lamp shield 42 can be tailored to a desired configuration.

In certain rare instances, or on an emergency, temporary basis, the lamp shield can be made to cover the entire outer end of lamp 12 by simply painting the end with a high temperature black or reflective paint, such as is commercially available. The entire end must be painted because the exact final orientation of lamp 12 in socket 14 is not known as lamp 12 is screwed into place.

In operation, the invention 10 functions as follows. Depending upon the nature of the glare problem, a reflector shield 22, glare shield 24 (or 25), or lamp shield 42 (or 51) can be used as desired. Used individually, each would control a portion of glare emanating from lamp 12 and reflector 16. Glare shield 24 (or 25) would block and redirect any light angling extremely upwardly and outwardly from lamp 12 and reflector 16, and thereby reduce glare in that manner. Reflector shield 22 would direct any light incident upon it divergingly downward and thus reduce reflected light leaving reflector 16 upwardly and outwardly, thus reducing glare. Lamp shield 42 (or 51) would block and redirect light emanating directly from the end of lamp 12, and in particular, any light emanating directly upwardly and outwardly, thereby reducing glare.

Combining any of reflector shield 22, glare shield 24 (or 25), and lamp shield 42 (or 51) would further control glare. Glare shield 24 (or 25), in cooperation with either reflector shield 22 or lamp shield 42 (or 51), or both, would serve to additionally prevent light from escaping lamp 12 and reflector 16 upwardly and outwardly.

It will be appreciated that the present invention can take many forms and embodiments. The true essence and spirit of this invention are defined in the appending claims, and it is not intended that the embodiment of the invention presented herein should limit the scope thereof. For example, the exact manner of attachment and configuration of glare shield 24, reflector shield 22, and lamp shield 24 can vary within the scope of the invention.

It is also to be understood that a major advantage of the invention is that the addition of any of reflector shield, glare shield, or lamp shield, can be accomplished either in original manufacturing of the invention 10, or by retrofitting it to existing lamp, lamp socket, and reflector assemblies. Many glare problems exist with presently operating conventional lighting units. After determining the nature of the glare problem, it can be controlled by utilizing the present invention. Reflector glare and/or lamp shields can be retrofitted to the existing lamp and reflector, or a new lamp or reflector can be utilized with any of those elements installed.

It may occur that an existing reflector may not reflect light convergingly in both upper and lower hemispheres. It is to be understood that the invention requires only that a predetermined angular section, (usually less than 180°, and preferred to be around 120°) in the lower hemisphere of the reflector cause diverging reflection; and that the remaining portion of the reflector cause converging reflection. Thus, if the reflector is diverging in its upper hemisphere, a retrofit converging reflector shield can be installed. Conversely, if the lower hemisphere is originally diverging, a diverging reflector shield may not be needed. To avoid extensive modification, the reflector can simply be replaced with one capable of easy modification in accordance with the invention.

The included preferred embodiments are given by way of example only, and not by way of limitation to the invention, which is solely described by the claims herein. Variations obvious to one skilled in the art will be included within the invention defined by the claims.

What is claimed is:

1. A method of selectively controlling light from one or more wide scale lighting luminaire assembly units for field or light target areas having different glare, spill light, and lighting halo problems, each including a lamp mounted in a reflector having a reflecting surface, while at the same time still permitting effective utilization of each said luminaire assembly unit for the production of maximum uniform, quality, composite, wide scale lighting of field or light target areas comprising:

determining the precise lighting requirements and glare problems including, but not limited to, glare, lighting halo, and lighting spill of a particular field or light target area location;

determining the desired lighting characteristics of each luminaire assembly so that the composite wide scale lighting for the field target area will reduce the precise glare problems by selectively and compositely reducing at least one of minimum glare, minimum lighting halo, and minimum lighting spill, while still permitting high utilization and playability of said target area for use; and changing the lamp and reflector lighting and reflecting properties of each luminaire assembly unit to produce composite wide scale lighting with the desired lighting characteristics but without undesired significant upwardly directed stray light, glare, or light spill by selectively adding, as needed, a removable lamp shield to said lamp, a removable glare shield to said reflector, and a removable reflector shield to the portion of the reflecting surface of said symmetrical reflector.

2. The method of claim 1 wherein said lamp shield comprises an opaque means selectively positionable on any portion of the lamp to block at least a portion of the light emanating from the lamp.

3. The method of claim 2 wherein the interior side of the opaque means is non-reflective.

4. The method of claim 2 wherein the interior side of the opaque means is reflective to both block and redirect a portion of the light emanating from the lamp.

5. The method of claim 2 wherein the opaque means comprises an independently mountable member.

6. The method of claim 2 wherein the opaque means comprises paint which can be applied directly to the lamp.

7. The method of claim 1 wherein the glare shield comprises a means mountable to the reflector and extending outwardly from the reflector to block and redirect light emanating from the lamp and reflector.

8. The method of claim 7 wherein the glare shield extends outwardly from a portion of the upper hemisphere of the reflector.

9. The method of claim 1 wherein said reflector shield comprises a means for altering the reflective properties of the reflector from those of the conventional symmetrical converging reflector to redirect light.

10. The method of claim 9 wherein the reflecting properties of the reflector are altered generally in the lower hemisphere of the reflector.

11. The method of claim 10 wherein the lower hemisphere of the reflector is converted from converging to diverging reflective properties.

12. The method of claim 10 wherein the reflector shield is an independent member mounted upon the interior of the reflector.

13. The method of claim 9 wherein the reflector shield is produced by altering the shape of the conventional symmetrical reflector.

14. A method for producing wide scale, composite lighting of desired and sufficient intensity, quality, and uniformity in and throughout a target space while selectively controlling, diminishing, or eliminating glare, spill light, and any dome or halo effect outside of the target space, said lighting being produced by one or more lamps mounted in reflector, comprising luminaire assembly units, comprising the steps of:

determinig the light producing characteristic of each luminaire assembly unit;

determining the sufficient intensity and uniformity of light desired for the target space;

determining the glare, spill light, and dome or halo effect problems, if any, for conventional wide scale lighting of the target space;

producing wide scale composite lighting while at the same time controlling, diminishing, or eliminating selected wide scale lighting problems by selectively utilizing one or more light controlling steps comprising:

shielding a portion of the lamp;

positioning a reflector extension member on the reflector; and altering the reflecting properties of the interior reflecting surface of the reflector.

15. A glare control lighting fixture for wide scale lighting of a field or light target area, comprising:

a conventional luminaire assembly unit having a converging symmetrical reflector with a circular perimeter edge, and a lamp, axially mounted, centrally in said reflector, for providing controlled wide scale light to the field or light target area and including at least one of the following to control, diminish or eliminate selected wide scale lighting problems including, but not limited to, glare, spill light, or halo effect;

a glare shield removably positioned on said symmetrical reflector perimeter edge and extending outwardly from the top of said reflector to block and reflect incident light of said lamp and reflector downwardly;

a removable lamp shield of conforming shape to said lamp positioned in intimate covering relationship with a portion of said lamp to block a portion of light emanating directly from said lamp; and a diverging reflector shield removably positioned on said symmetrical reflector below said lamp to cause incident light from said lamp and reflector to be directed divergingly downward and to prevent incident light from being reflected upwardly.

16. The device of claim 15 wherein the glare shield is positioned around generally the upper hemisphere of the reflector.

17. The device of claim 15 wherein the lamp shield is opaque having an inner surface which is non-reflective.

18. The device of claim 15 wherein the lamp shield is opaque and has an inner surface which is reflective.

19. The device of claim 15 wherein the lamp shield comprises an independent member mountable upon said lamp.

20. The device of claim 15 wherein said lamp shield is comprised of paint.

21. The device of claim 15 wherein the reflector shield is positioned generally within the lower hemisphere of the reflector.

22. The device of claim 15 wherein the reflector shield comprises an independent member mountable on said reflector.

23. The device of claim 15 wherein the reflector shield comprises a reforming of the lower portion of said reflector.

24. The fixture of claim 15 wherein the luminaire assembly unit is positioned at an elevated height and oriented toward the target area.

25. The fixture of claim 24 wherein a plurality of luminaire assembly units are positioned at an elevated height and oriented to the target area to produce collective lighting of the target area.

26. The fixture of claim 15 wherein the application of the glare shield, lamp shield, and reflector shield are selective according to choice and according to different glare, spill light, and light halo problems associated with different target areas.

27. A glare control lighting array for producing composite, wide-scale lighting of a field or light target area, comprising:

one or more luminaire assembly units, each having a converging reflector with a perimeter edge, and lamp mounted in said reflector, for providing controlled wide-scale composite light to a target area; selected luminaire assembly units including at least one of the following to control, diminish or eliminate selected wide scale lighting problems, including, but not limited to, glare, spill light, or halo effects;

a glare shield removably positioned on said reflector perimeter edge and extending outwardly from the top of said reflector to block and reflect incident light of said lamp and reflector downwardly;

a removable lamp shield of conforming shape to said lamp positioned in intimate covering relationship with a portion of said lamp to block and reflect a portion of light emanating directly from said lamp; and a diverging reflector shield removably positioned on said symmetrical reflector below said lamp to cause incident light from said lamp and reflector to be directed divergingly downward and to prevent incident light from being reflected upwardly.

* * * * *

US004725934C1

(12) EX PARTE REEXAMINATION CERTIFICATE (5386th)

United States Patent
Gordin

(10) Number: US 4,725,934 C1
(45) Certificate Issued: Jun. 6, 2006

(54) GLARE CONTROL LAMP AND REFLECTOR ASSEMBLY AND METHOD FOR GLARE CONTROL

(75) Inventor: Myron K. Gordin, Oskaloosa, IA (US)

(73) Assignee: Musco Corporation, Des Moines, IA (US)

Reexamination Request:
No. 90/003,998, Oct. 2, 1995

Reexamination Certificate for:

| | |
|---|---|
| Patent No.: | **4,725,934** |
| Issued: | **Feb. 16, 1988** |
| Appl. No.: | **07/091,364** |
| Filed: | **Aug. 28, 1987** |

Related U.S. Application Data

(63) Continuation of application No. 06/865,086, filed on May 19, 1986, now abandoned, which is a continuation of application No. 06/687,864, filed on Dec. 31, 1984, now abandoned.

(51) Int. Cl.
*F21V 7/00* (2006.01)

(52) U.S. Cl. ..... 362/298; 362/256; 362/277; 362/346

(58) Field of Classification Search ..... None
See application file for complete search history.

(56) References Cited

U.S. PATENT DOCUMENTS 1,987,112 A * 1/1935 Kerr ..... 362/256
2,226,879 A * 12/1940 Stam ..... 362/256

OTHER PUBLICATIONS

1979 Musco Product Guide.
1981 Musco Product Guide.
"A Complete Guide to the Language of Lighting" McGraw–Edison Company, 1983.
"The Optical Design of Reflectors", William B. Elmer, 2nd Ed. 1980, p. 196.
"IES Lighting Handbook, The Standard Lighting Guide" 4th ed, 1966 p. 19–20.
"Lighting For Athletic Fields Provides Cost–Effective Illumination" Jay J. Can, P.E. Nov./Dec. 1982, p. 31.
"Lighting Design for Outdoor Sports Areas: Lamp and Equipment Basics", The Electrical Distributor, Jun. 1973.
"Lighting Design for Outdoor Sports Areas: Baseball, Football, Softball Fields", 1973.
"Current Recommended Practice for Sports Lighting", 1968 p. 11.
"Current Recommended Practice for Sports Lighting," 1961, p. 63.

* cited by examiner

*Primary Examiner*—Stephen Husar

(57) ABSTRACT

A glare control lamp and reflector assembly and method for glare control which includes a conventional lamp and symmetrical reflector for providing a controlled light beam to a target area. A reflector shield can be positioned on the reflector below the lamp and has the properties of diverging incident light downwardly towards the target area and thus controls reflection upwardly which would produce glare. A glare shield can be positioned on the top of the reflector and extends outwardly from the outer edge of the reflector to block both direct light and reflected light from traveling upwardly and outwardly which would produce glare. In a further combination, a lamp shield can be positioned over a portion of the outermost extending end of the lamp to prevent unreflected light from directly causing glare. The method for controlling glare includes the steps of providing a conventioal lamp and reflector assembly, positioning a reflector shield in the bottom of the reflector beneath the bulb to diverge instant light downwardly to the target area, and providing a glare shield extending around and outwardly from the top of the reflector to block and divert incident light downwardly towards the target area. An additional step would be to provide a lamp shield over the outwardmost end of the lamp to block directly emanating light from causing glare.

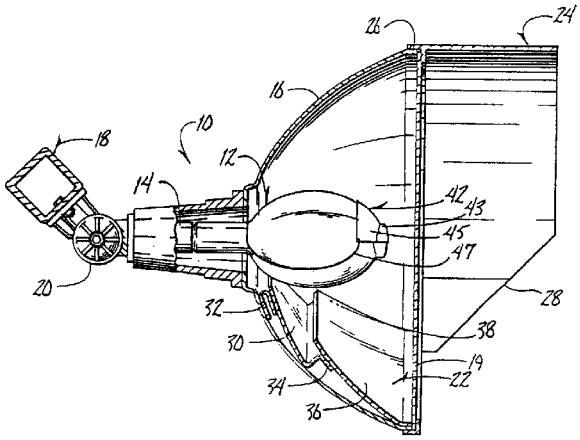

EX PARTE REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–27 are cancelled.

* * * * *